US005918615A

United States Patent [19]

Stuck, Sr.

[11] Patent Number: 5,918,615

[45] Date of Patent: Jul. 6, 1999

[54] PORTABLE SHELTER

[75] Inventor: Matthew A. Stuck, Sr., Menasha, Wis.

[73] Assignee: Modern Manufacturing Inc., Menasha, Wis.

[21] Appl. No.: 08/988,810

[22] Filed: Dec. 11, 1997

[51] Int. Cl.[6] ..... E04H 15/44

[52] U.S. Cl. ..... 135/135; 135/132; 135/147; 135/152; 135/117

[58] Field of Search ..... 135/132, 133, 135/135, 137, 147, 148, 152, 153, 120.1, 117, 901

[56] References Cited

U.S. PATENT DOCUMENTS

| | | | |
|---|---|---|---|
| 34,569 | 3/1862 | Fitzgerald . | |
| 513,841 | 1/1894 | Tolmie | 135/117 X |
| 1,169,521 | 1/1916 | Taylor . | |
| 1,581,180 | 4/1926 | Csajaghy et al. | 135/90 |
| 2,942,609 | 6/1960 | Ferguson | 135/133 |
| 3,010,464 | 11/1961 | Moss . | |
| 3,213,868 | 10/1965 | Forbes | 135/116 X |
| 3,368,575 | 2/1968 | Besonen . | |
| 3,799,608 | 3/1974 | Smutny et al. | 135/901 X |
| 3,902,264 | 9/1975 | Radig . | |
| 4,084,599 | 4/1978 | Matthews . | |
| 4,520,835 | 6/1985 | Moeller . | |
| 4,612,948 | 9/1986 | Simpson | 135/120.1 X |
| 4,836,232 | 6/1989 | DeRosa et al. . | |
| 4,862,906 | 9/1989 | Jordon | 135/96 |
| 5,004,001 | 4/1991 | Bouchard . | |
| 5,368,057 | 11/1994 | Lubkeman et al. | 135/137 X |

*Primary Examiner*—Carl D. Friedman
*Assistant Examiner*—Winnie S. Yip
*Attorney, Agent, or Firm*—Andrus, Sceales, Starke & Sawall

[57] ABSTRACT

A portable collapsible shelter having particular use as a hunting blind. The shelter includes a plurality of generally C-shaped frame members and the upper ends of the frame members are connected to an upper connecting plate, while the lower portions of the frame members are connected to a lower connecting plate. A flexible cover is attached to the frame members and provides an enclosure. The frame members can be pivoted between a folded condition, where the frame members are in generally parallel relation, to an extended condition where the frame members extend radially from the connecting plates. The cover is provided with an access slit which extends the full height of the cover and can be closed through a fastener such as a zipper. An auxiliary panel can be connected to the side portion of the cover on either side of the slit. The panel extends outwardly from the cover and can be held in an outwardly bowed position by a ground stake. Side portions of the cover are provided with windows which can are enclosed by removable flaps and the flaps contain screened observation openings, as well as slits through which a gun can be inserted.

13 Claims, 3 Drawing Sheets

FIG. 3
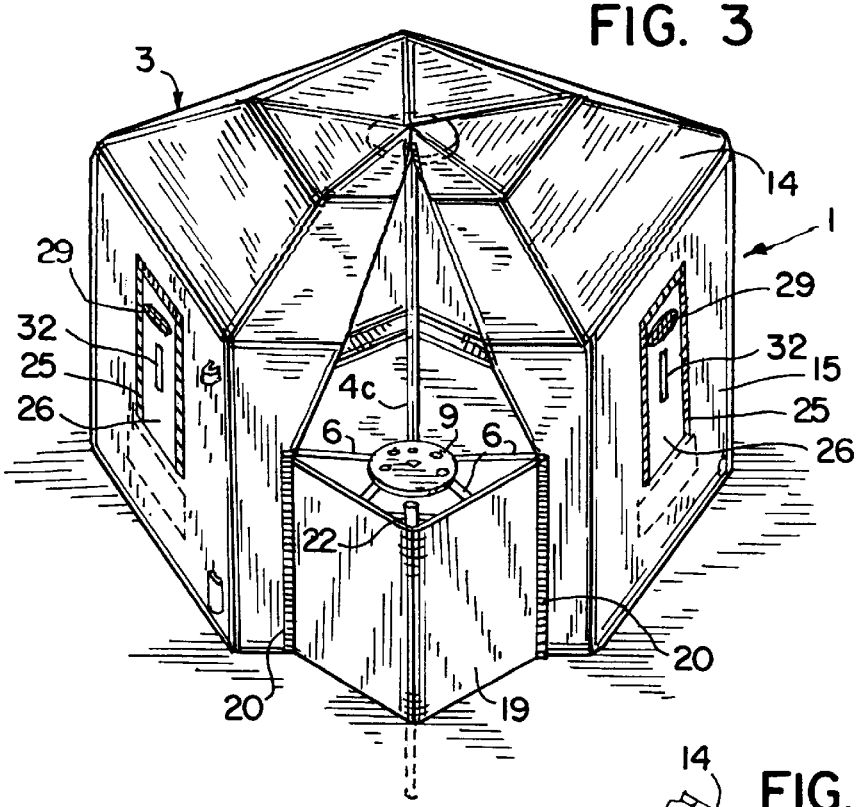
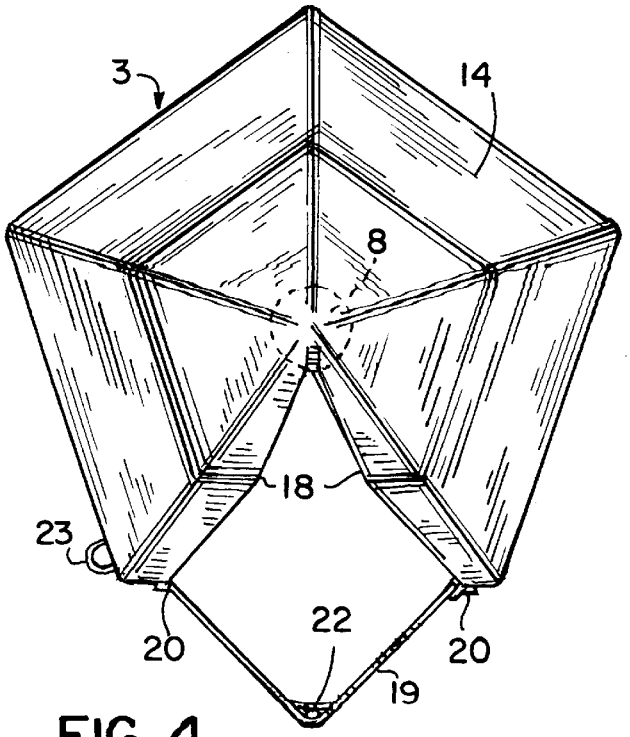
FIG. 4
FIG. 5
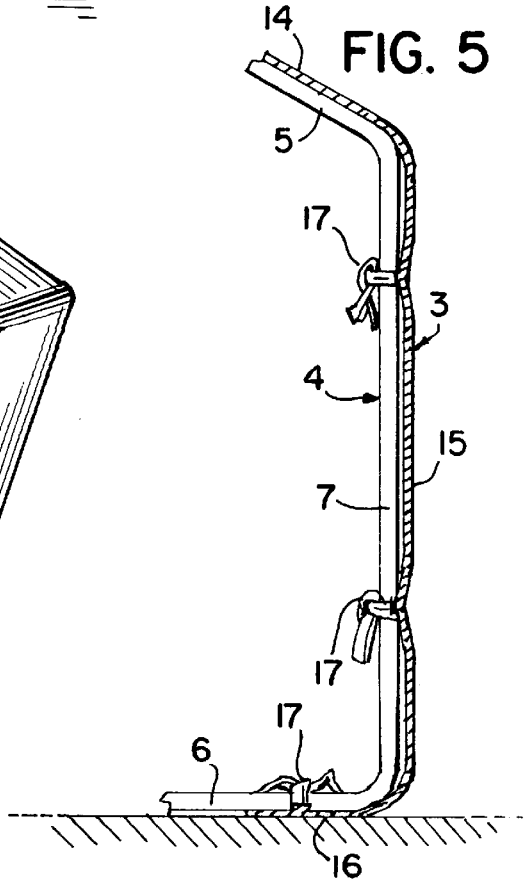

PORTABLE SHELTER

BACKGROUND OF THE INVENTION

Various types of portable shelters have been proposed in the past for use as hunting blinds, utility shelters, camping tents, and the like. In general, the typical shelter includes a series of generally C-shaped frame members and the upper ends of the frame members are pivotally connected to an upper plate or support, and similarly the lower ends of the frame members are pivotally connected to a lower plate or support. With this construction, the frame members can be pivoted between a collapsed or folded position where the frame members are generally parallel to each other to an extended position where the frame members extend radially. A flexible covering is attached to the frame members, and when the frame members are in the extended position, the covering provides an enclosure. Typical shelters of this type are shown in U.S. Pat. Nos. 3,368,575; 3,902,264; and 4,520,835.

SUMMARY OF THE INVENTION

The invention is directed to an improved portable and collapsible shelter that has particular use as a hunting blind. The shelter includes a plurality of generally C-shaped tubular frame members, each having an upper section, a generally horizontal lower section, and a vertical intermediate section that connects the upper and lower sections.

The upper sections of the frame members are connected to an upper connecting plate, while the lower sections of the frame members are similarly connected to a lower connecting plate. With this construction, the frame members can be moved between a folded position where the frame members are in generally parallel relation to an extended position where the frame members extend radially from the connecting plates.

The shelter also includes a flexible cover having a top portion which is supported on the upper sections of the frame member, and a depending side portion that extends along the vertical sections of the frame members. The cover is provided with a slit which extends from the top portion of the cover downward along the side portion to the bottom of the cover. When open, the slit provides access to the shelter, and the slit can be closed off by a fastener, such as a zipper.

As a feature of the invention, a flexible sheet or panel can be attached to a side portion of the cover on either side of the slit and the vertical side edges of the panel are connected to the side portion of the cover by fasteners, such as zippers. The panel is adapted to bow outwardly from the cover and can be held in the outwardly bowed condition by a ground stake. The panel, when installed with the cover, enables a hunter to stand outside of the shelter and yet be partially concealed and protected from the weather.

As a further aspect of the invention, the side portion of the cover can be provided with one or more windows each of which can be enclosed by a removable flap. In the preferred embodiment of the invention, each flap is provided with a screened opening, as well as a verticlaly elonagated slot. The screened opening enables a hunter within the shelter to view game or wildlife while concealing movement of the hunter and a gun barrel can be inserted through the slot.

Located beneath each window is a pocket that is removably connected to the inner surface of the cover and enables small items to be conveniently stored in an above ground location.

The shelter of the invention is lightweight and provides concealment, warmth and protection against the weather. It can be readily folded by one man from the collapsed or folded condition to the extended condition.

The shelter has particular use as a hunting blind, but can also be used as a utility shelter, a bus stop shelter, a camping tent, an ice fishing shelter, or the like.

When the slit in the cover is closed through use of the zipper or other fastener, a completely closed shelter is provided for complete protection against the weather. When used as a hunting blind, the installation of the auxiliary panel enables the hunter to stand outside of the shelter, which is desirable in waterfowl hunting, and yet be partially concealed by the panel.

Other objects and advantages will appear in the course of the following description.

DESCRIPTION OF THE DRAWINGS

The drawings illustrate the best mode presently contemplated of carrying out the invention.

In the drawings:

FIG. 3 is a perspective view of the shelter with the auxiliary panel being installed;

FIG. 4 is a top view of the shelter shown in FIG. 3;

FIG. 5 is a fragmentary vertical section showing the attachment of the cover to a frame member;

DESCRIPTION OF THE ILLUSTRATED EMBODIMENT

Figure 1:
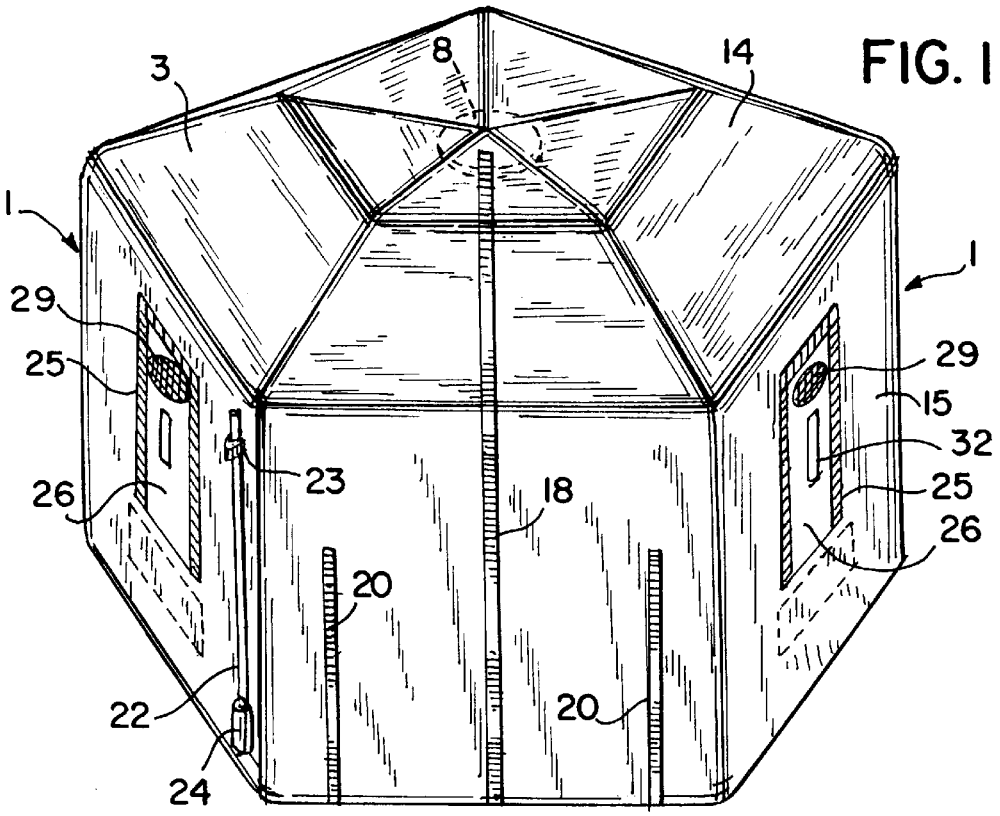
FIG. 1 is a perspective view of the assembled shelter of the invention.

FIG. 1 shows a portable, collapsible shelter 1, which has particular use as a hunting blind. Shelter 1 includes a frame 2 which supports an outer flexible cover 3.

Figure 2:
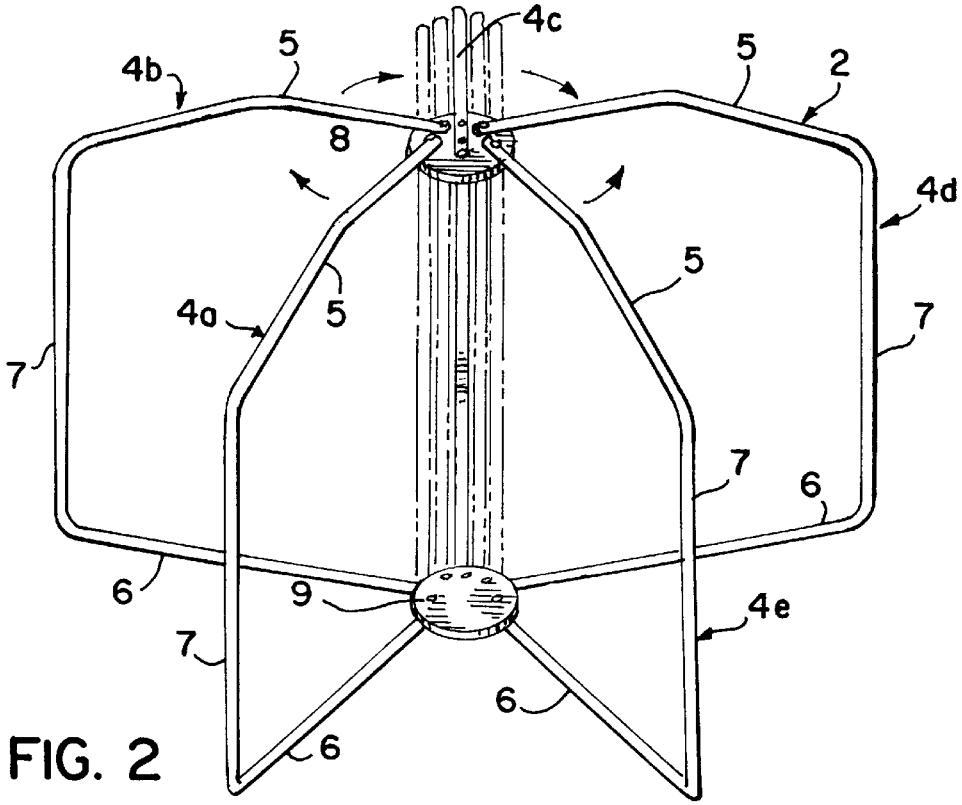
FIG. 2 is a perspective view of the frame.

As best shown in FIG. 2, frame 2 includes a plurality of tubular frame members 4*a–e*. Each frame member has a generally C-shaped configuration, and includes an upper section 5, a lower horizontal section 6, and a vertical section 7 which connects the upper section 5 with the lower section 6.

Figure 6:
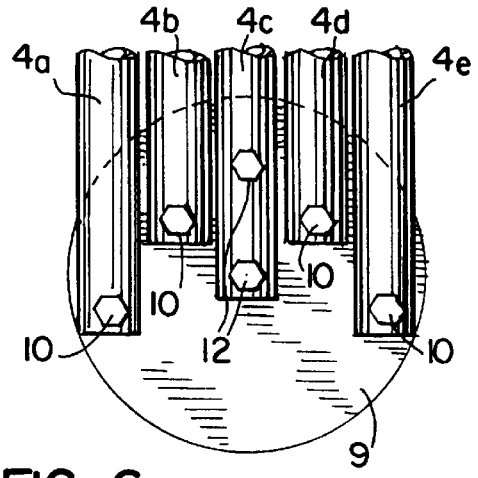
FIG. 6 is a fragmentary plan view showing the attachment of the frame members to a connecting plate, with the frame members being in the parallel folded condition.
Figure 7:
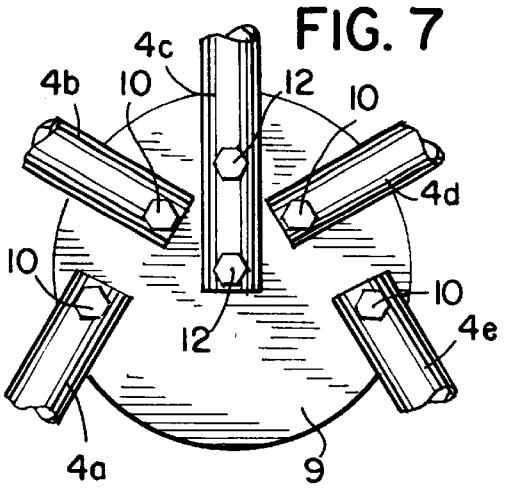
FIG. 7 is a view similar to FIG. 6 showing the frame members in the extended position.

The upper sections 5 of frame members 4*a–e,* are connected to an upper connecting plate 8, while the lower sections 6 of the frame members are connected in a similar manner to a lower connecting plate 9. FIGS. 6 and 7 show the connections of the upper frame sections 5 to the upper connecting plate 8. The frame members 4*a, b, d* and *e* are pivotally connected to plate 8 by bolts 10, while the frame member 4*c* is fixed to plate 8 by a pair of bolts 12. As shown in FIG. 6, the frame members 4*a, b, d* and *e* can be pivoted relative to frame member 4*c,* so that all of the frame members are in a parallel folded condition. FIG. 7 shows the frame members in the extended position where the frame members 4*a–e* all extend radially from plate 8.

The lower sections 6 of frame members 4*a–e* are connected in the same manner to the lower connecting plate 9.

The cover 3, which can be formed of canvas, plastic material, or the like, includes a top portion 14 which is supported on the upper sections 5 of frame members 4*a–e,* and a depending side portion 15 which extends downwardly along the vertical section 7 of the frame members. As best shown in FIG. 4, the bottom edge 16 of cover 3 extends partially beneath the horizontal lower section 6 of the frame members. The cover can be connected to the frame members 4*a–e* by a series of ties 17, as shown in FIG. 5. As the cover 3 does not extend completely across the bottom of the shelter, the major portion of the bottom is open for convenience in ice fishing.

To provide access to the interior of the enclosure a slit is provided in the cover which can be closed by a zipper 18. The slit extends from the top portion 14 of the cover downwardly along the side portion 15 and terminates in the bottom edge 16. By unzipping the zipper 18, access can be had to the interior of the shelter.

As a feature of the invention, an auxiliary panel or sheet 19 can be connected to cover 3 on either side of the open slit. To connect panel 19 to the cover, a pair of fasteners 20, such as zippers, are located on either side of the slit. However, it is contemplated that other types of fasteners, such as grippers, hook and loop type fasteners, can be utilized.

The vertical sided edges of the panel are also provided with fasteners which engage the fasteners 20 on cover 3. FIG. 3 shows the panel 19 as attached to the cover 3. The horizontal width of the fastener is greater than the distance between the fasteners 20 on cover 3, so that when the panel 19 is installed with the cover 3 the panel will bow or project outwardly, as shown in FIGS. 3 and 4. Panel 19 can be retained in the outwardly bowed condition by a ground stake 22 which is inserted into the ground. When installed, panel 19 enables a hunter to stand outside of the shelter and yet the lower portion of the hunter will be concealed by the panel.

When not in use, stake 22 can be stored on the outer surface of cover 3. Stake 22 can be inserted through a loop 23 provided on the upper edge of the side portion 15 of the cover, and the lower end of the stake can be received within a pocket 24, as best shown in FIGS. 1 and 3.

As a feature of the invention, side portion 15 of cover 3 is formed with one or more windows 25 which can be enclosed by flaps 26. As best shown in FIG. 6, the lower edge of each flap 26 is formed integrally with the side portion 15 of the cover, and the vertical side edges of the flap can be attached to the cover through fasteners 27, such as a zipper, grippers, hook and loop fastener, or the like. The upper edge of flap 26 is provided with a tab 28 which can be attached to the inner surface of cover 3 through use of a hook and loop type fastener.

As shown in FIG. 6, each window 25 can be provided with an opening 29 enclosed by a screen 30. Located beneath each opening 29 is a vertically elongated slot 32 through which a gun can be inserted. With the window 25 in the closed position, the hunter within the shelter can observe wildlife or game through the screened opening 29 and can insert the gun barrel through the slot 32. Alternately, when a larger opening is needed, as in bow hunting, the window 25 can be detached from the cover and the hunter and observe and shoot through the opened window 25.

Figure 8:
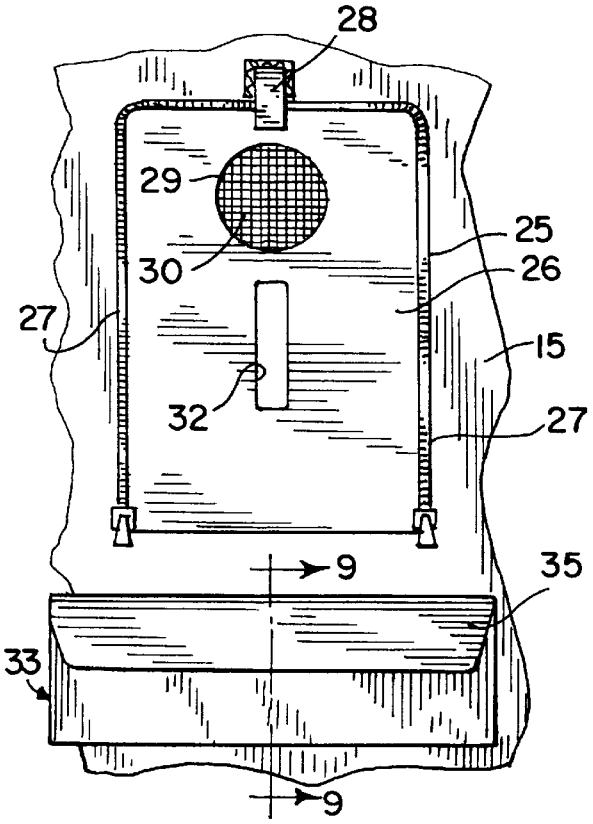
FIG. 8 is a fragmentary elevational view of the interior of the cover showing a closed window with a pocket therebeneath.
Figure 9:
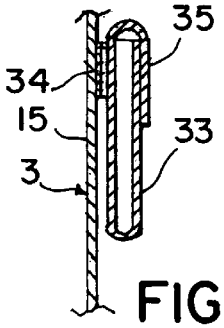
FIG. 9 is a section taken along line 9—9 of FIG. 8.

As shown in FIGS. 8 and 9, a pocket 33 can be attached to the inner surface of cover 3 through a hook and loop type fastener 34. Pocket 34 is provided with an outer flap 35 which encloses the open upper end of the pocket. The pocket provides a convenient means for storing small objects in an above-ground location. The pocket can be removed from the cover, if desired, before folding the shelter to its collapsed position.

Figure 10:
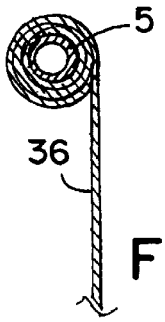
FIG. 10 is a fragmentary vertical section showing a shell deflecting curtain partially rolled onto a frame member.
Figure 11:
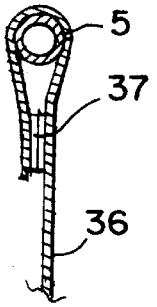
FIG. 11 is a view similar to FIG. 6 showing the curtain in the unrolled condition.

FIGS. 10 and 11 illustrate a shell ejecting curtain 36 that can be attached to the upper section 5 of one of the frame members 4*a–e.* The upper end of the curtain 36 can be attached around the frame section 5 by a hook and loop fastener 37. FIG. 10 shows the curtain in a partially rolled-up condition around the frame member, while FIG. 11 shows the curtain in the lowered or extended condition. The curtain is useful when more than one hunter is in the shelter, and will prevent shells being ejected from the gun of one of the hunters from striking the other hunter.

The shelter is lightweight and can be readily folded by one man from the collapsed or folded condition to the extended condition. While the above description has shown the use of the shelter as a hunting blind, it is also contemplated that the shelter can be used as a bus stop shelter, utility shelter, camping tent, ice fishing shelter, or other similar uses.

I claim:

1. A portable foldable shelter, comprising a plurality of frame members each having an upper section and a lower section and a generally vertical intermediate section connecting said upper and lower sections, first connecting means for connecting said upper sections together, second connecting means for connecting said lower sections together, said frame members being movable between a generally parallel folded position and an extended position where said frame members extend generally radially from said first and second connecting means, a flexible cover having a top portion supported by the upper sections of said frame members and a depending side portion extending along said vertical sections of said frame members, said cover having a slit in said top portion and extending downwardly along said side portion, fastening means for removably closing said slit, a flexible panel having a pair of generally vertical side edges, and second fastening means for removably connecting said side edges of the panel to the side portion of said cover, said second fastening means being located on either side of said slit and spaced horizontally from said slit, the horizontal dimension of said panel being greater than the horizontal distance between said second fastening means, whereby the panel extends outwardly from the cover in a generally bowed condition to provide an access area between the cover and the panel, and means to maintain the panel in the bowed condition.

2. The shelter of claim 1, wherein the vertical height of the side edges of the panel is less than the vertical height of the side portion of the cover.

3. The shelter of claim 1, wherein said first fastening means and said second fastening means comprise zippers.

4. The shelter of claim 1, wherein said side portion of the cover is provided with a window, a flap to removably enclose said window, said flap having an observation opening and having an elongated vertical slit adjacent said opening.

5. The shelter of claim 4, and including a screen covering said observation opening.

6. The shelter of claim 4, and including means for removably connecting said flap to the side portion of said cover.

7. The shelter of claim 4, and including a pocket removably connected to the inner surface of the side portion of said cover adjacent said window.

8. The shelter of claim 1, wherein the means to maintain the panel in the bowed condition comprises a support member engaged with the ground.

9. The shelter of claim 1, wherein the panel extends generally vertically and has a generally horizontal upper edge spaced beneath the upper edge of the side portion of the cover.

10. A portable foldable shelter comprising a plurality of frame members each having an upper section and a lower section and a generally vertical intermediate section connecting said upper section and said lower section, an upper connecting plate connected to the upper sections of said frame members, a lower connecting plate connected to the lower sections of said frame members, a flexible cover having an upper portion supported on the upper sections of said frame members and having a depending side portion extending downwardly along said vertical sections of said frame members, said cover having a slit in said top portion and extending downwardly along said side portion to provide access to the interior of said cover, a flexible panel having a pair of generally vertical side edges, fastening means for removably connecting the side edges of the panel to the side portion of the cover on either side of said slit, the vertical height of said side edges being less than the vertical height of the side portion of said cover and the horizontal dimension of said panel being greater than the horizontal distance between said fastening means whereby said panel projects outwardly from said cover in a bowed condition to provide an access area between the cover and the panel, and means to maintain said panel in the bowed condition.

11. The shelter of claim 10, wherein said means to retain the panel in the bowed condition comprises a stake engaged with the ground.

12. The shelter of claim 10, wherein the side portion of said cover has a window, a flap to removably cover said window, said flap having an observation opening and an elongated slit adjacent said opening.

13. The shelter of claim 10, and including a shell deflecting curtain supported on the upper section of a frame member, said curtain hanging downwardly from said upper section and being spaced from the side portion of the cover.

* * * * *